US010718351B2

(12) United States Patent
Kono et al.

(10) Patent No.: US 10,718,351 B2
(45) Date of Patent: Jul. 21, 2020

(54) CENTRIFUGAL BLOWER, AIR CONDITIONING APPARATUS, AND REFRIGERATING CYCLE APPARATUS

(71) Applicant: Mitsubishi Electric Corporation, Tokyo (JP)

(72) Inventors: Atsushi Kono, Tokyo (JP); Takashi Ikeda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 186 days.

(21) Appl. No.: 15/745,727

(22) PCT Filed: Aug. 6, 2015

(86) PCT No.: PCT/JP2015/072311
§ 371 (c)(1),
(2) Date: Jan. 18, 2018

(87) PCT Pub. No.: WO2017/022115
PCT Pub. Date: Feb. 9, 2017

(65) Prior Publication Data

US 2018/0209440 A1 Jul. 26, 2018

(51) Int. Cl.

| | |
|---|---|
| ***F04D 29/66*** | (2006.01) |
| ***F04D 29/42*** | (2006.01) |
| ***F04D 29/44*** | (2006.01) |
| *F04D 29/28* | (2006.01) |

(52) U.S. Cl.
CPC ..... *F04D 29/4226* (2013.01); *F04D 29/422* (2013.01); *F04D 29/441* (2013.01); *F04D 29/663* (2013.01); *F04D 29/667* (2013.01); *F04D 29/282* (2013.01)

(58) Field of Classification Search
CPC .. F04D 29/4226; F04D 29/441; F04D 29/663; F04D 29/422; F04D 29/667
See application file for complete search history.

(56) References Cited

FOREIGN PATENT DOCUMENTS

| | | | |
|---|---|---|---|
| CN | 1752460 | A | 3/2006 |
| CN | 103486078 | A | 1/2014 |
| CN | 204267376 | U | 4/2015 |
| CN | 104728172 | B | 6/2015 |
| EP | 2503157 | A1 | 9/2012 |
| JP | S64-087900 | A | 3/1989 |

(Continued)

OTHER PUBLICATIONS

Office Action dated Aug. 1, 2019 issued in corresponding CN patent application No. 201580082146.8 (and English translation).

(Continued)

*Primary Examiner* — J. Todd Newton
*Assistant Examiner* — Sabbir Hasan
(74) *Attorney, Agent, or Firm* — Posz Law Group, PLC

(57) ABSTRACT

A centrifugal blower includes a centrifugal fan having a main plate and a side plate facing each other in a direction of a rotation axis, and a casing to house the centrifugal fan. The casing has a peripheral wall extending along an outer circumferential edge of the centrifugal fan, and has a tongue portion at a position on the peripheral wall. A distance between the outer circumferential edge of the centrifugal fan and the tongue portion is smaller on the main plate side of the centrifugal fan than on the side plate side of the centrifugal fan.

20 Claims, 9 Drawing Sheets

(56) References Cited

FOREIGN PATENT DOCUMENTS

| | | | | | |
|---|---|---|---|---|---|
| JP | H05-038395 | U | | 5/1993 | |
| JP | H0538395 | U | * | 5/1993 | ..... F04D 29/422 |
| JP | H07-014192 | U | | 3/1995 | |
| JP | 2009-270778 | A | | 11/2009 | |
| JP | 2009-287427 | A | | 12/2009 | |
| JP | 2009287427 | A | * | 12/2009 | |
| JP | 2010-77851 | A | | 4/2010 | |
| JP | 2011-127586 | A | | 6/2011 | |
| JP | 2012-21431 | A | | 2/2012 | |

OTHER PUBLICATIONS

Submission of Publication submitted to the JPO by a third party dated Aug. 24, 2018 corresponding to JP patent application No. 2017-532331 (and English machine translation thereof).
Office Action dated Dec. 24, 2018 issued in corresponding CN patent application No. 201580082146.8 (and English translation).
International Search Report of the International Searching Authority dated Nov. 2, 2015 for the corresponding International application No. PCT/JP2015/072311 (and English translation).
Extended European Search Report dated Jul. 19, 2018 issued in corresponding EP patent application No. 15900426.6.
Office Action dated Oct. 1, 2019 issued in corresponding JP patent application No. 2018-209362 (and English translation).
Submission of Publication submitted to the JPO by a third party dated Nov. 25, 2019 in corresponding JP patent application No. 2018-209362 (and English translation) with cited references.
Office Action dated Dec. 12, 2019 issued in corresponding CN patent application No. 201580082146.8 (and English translation).
Office Action dated Mar. 20, 2020 issued in corresponding CN patent application No. 201580082146.8 (and English tanslation).

* cited by examiner

CENTRIFUGAL BLOWER, AIR CONDITIONING APPARATUS, AND REFRIGERATING CYCLE APPARATUS

CROSS REFERENCE TO RELATED APPLICATION

This application is a U.S. national stage application of International Patent Application No. PCT/JP2015/072311 filed on Aug. 6, 2015, the disclosure of which is incorporated herein by reference.

TECHNICAL FIELD

The present invention relates to a centrifugal blower, an air conditioning apparatus, and a refrigerating cycle apparatus.

BACKGROUND ART

Conventionally, there have been known centrifugal blowers including a scroll casing and a multiblade type centrifugal fan. In the centrifugal blower, noise called wind noise occurs due to pressure change when blades of the fan pass in the vicinity of a tongue portion provided in the scroll casing. Thus, in a centrifugal blower disclosed in Patent Reference 1, the tongue portion is configured stepwise so that a distance between the tongue portion and the fan is larger on a main plate side of the fan than on a side plate side (an intake side) of the fan.

PATENT REFERENCE

Patent Reference 1: Japanese Utility Model Application Publication No. H7-14192 (see FIG. 4 and FIG. 5)

Here, in a centrifugal blower, although most of the air blown out from the fan is directed toward an outlet port of the scroll casing, there also occurs a circulating flow passing through a gap between the tongue portion and the fan and circulating inside the scroll casing without being directed toward the outlet port. If the distance between the tongue portion and the fan is increased in order to restrict the noise, the circulating flow increases accordingly. The increase in the circulating flow leads to an increase in pressure loss and causes a decrease in efficiency of the centrifugal blower.

SUMMARY

The present invention has been made to solve the above-described problem, and an object of the present invention is to provide a centrifugal blower, an air conditioning apparatus, and a refrigerating cycle apparatus capable of enhancing efficiency and reducing noise.

A centrifugal blower according to the present invention includes a centrifugal fan having a main plate and a side plate facing each other in a direction of a rotation axis, and a casing to house the centrifugal fan. The casing has a peripheral wall extending along an outer circumferential edge of the centrifugal fan, and has a tongue portion at a position on the peripheral wall. A distance between the outer circumferential edge of the centrifugal fan and the tongue portion is smaller on the main plate side of the centrifugal fan than on the side plate side of the centrifugal fan.

According to the present invention, a circulating flow in the casing can be reduced by decreasing the distance between the outer circumferential edge of the centrifugal fan and the tongue portion on the main plate side of the centrifugal fan. Further, the noise can be restricted by securing a distance between the outer circumferential edge of the centrifugal fan and the tongue portion on the side plate side of the centrifugal fan. Consequently, efficiency can be enhanced, and noise can be reduced.

DETAILED DESCRIPTION

Embodiments of the present invention will be described below with reference to the accompanying drawings.

First Embodiment (Configuration of Air Conditioning Apparatus)

Figure 1:
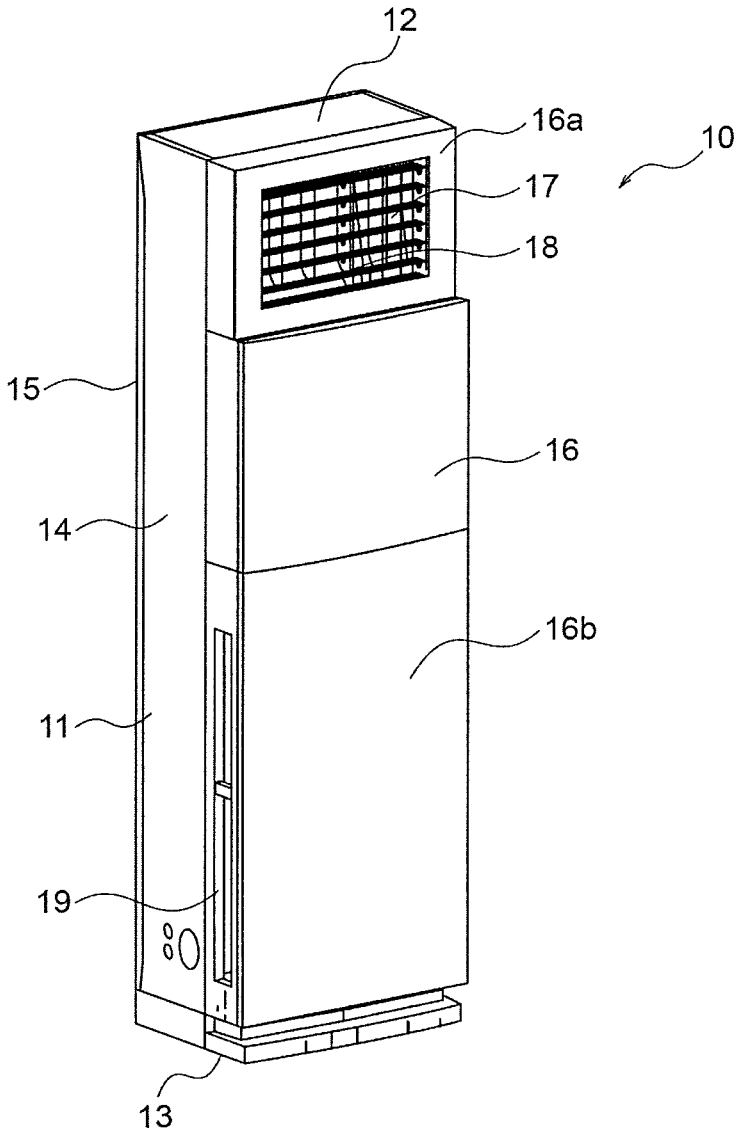
FIG. 1 is a perspective view showing an external shape of an air conditioning apparatus according to a first embodiment of the present invention.

FIG. 1 is a perspective view showing an external shape of an air conditioning apparatus according to a first embodiment of the present invention. Specifically, the air conditioning apparatus according to the first embodiment is an indoor unit of a so-called packaged air conditioner, and is used in combination with an outdoor unit.

As shown in FIG. 1, the air conditioning apparatus 10 includes a housing 11 set on a floor of an air conditioning object space (an inside of a room). In this example, the housing 11 includes a top surface part 12, a bottom surface part 13, side surface parts 14, a back surface part 15, and a front surface part 16.

An outlet port 17 is formed in an upper part of the front surface part 16. The outlet port 17 is, for example, an opening having a rectangular shape. The outlet port 17 is provided with a plurality of vanes 18 for controlling wind direction. The vanes 18 are configured to be able to adjust the wind direction in a vertical direction and in a horizontal direction.

Each side surface part 14 is provided with an intake port 19. The intake port 19 is, for example, an opening elongated in the vertical direction. A filter for removing dust from air passing through the intake port 19 is attached to the intake port 19.

Incidentally, in the example shown in FIG. 1, a front upper part cover 16*a* and a front lower part cover 16*b* are detachably attached to a front surface of the housing 11. The outlet port 17 is formed in the front upper part cover 16*a*, while the intake port 19 is formed in each of two side parts of the front lower part cover 16*b*. However, the outlet port 17 and the intake ports 19 are not limited to such examples.

Figure 2:
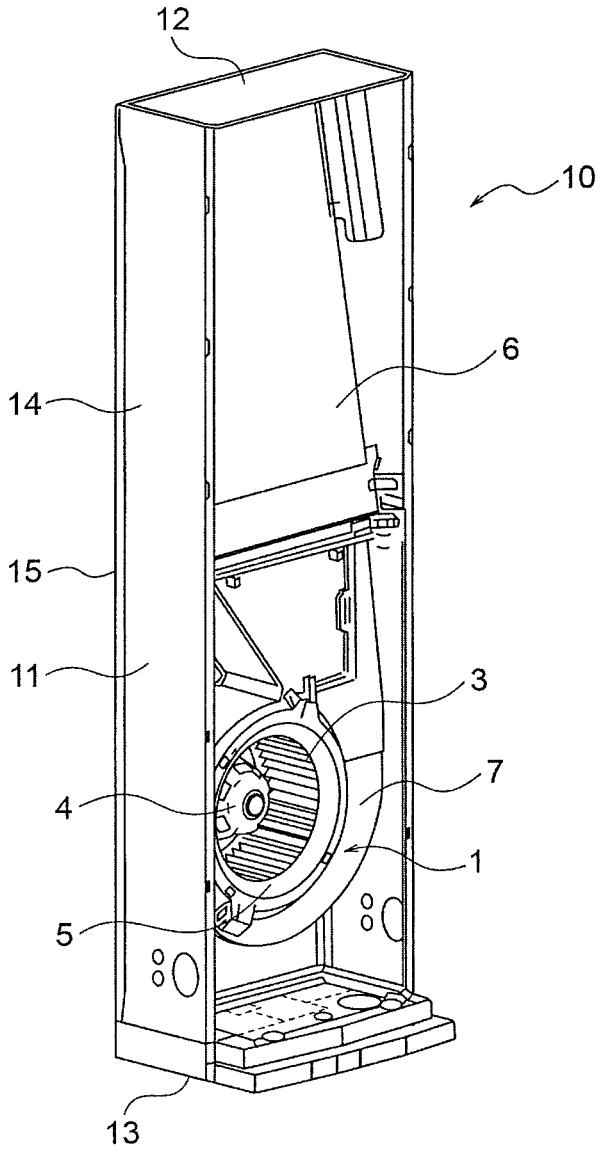
FIG. 2 is a perspective view showing an internal configuration of the air conditioning apparatus according to the first embodiment of the present invention.

FIG. 2 is a perspective view showing an internal configuration of the air conditioning apparatus 10 by detaching the front upper part cover 16*a* and the front lower part cover 16*b* therefrom. As shown in FIG. 2, a centrifugal blower 1 and a heat exchanger 6 are housed in the housing 11.

The centrifugal blower 1 takes air into an inside of the housing 11 from the intake ports 19 (FIG. 1) and blows out the air from the outlet port 17 (FIG. 1) toward the object space (the inside of the room). In other words, the centrifugal blower 1 generates an air flow that is taken into the inside of the housing 11 from the intake ports 19 and is blown out from the outlet port 17 into the object space.

The heat exchanger 6 is disposed in a channel (an air channel) extending from the centrifugal blower 1 toward the outlet port 17. The heat exchanger 6 performs heat exchange and humidity exchange of the air flowing from the centrifugal blower 1 toward the outlet port 17. The air having passed through the heat exchanger 6 is blown out from the outlet port 17. Incidentally, a configuration and a mode of the heat exchanger 6 are not particularly limited.

(Configuration of Centrifugal Blower)

Figure 3:
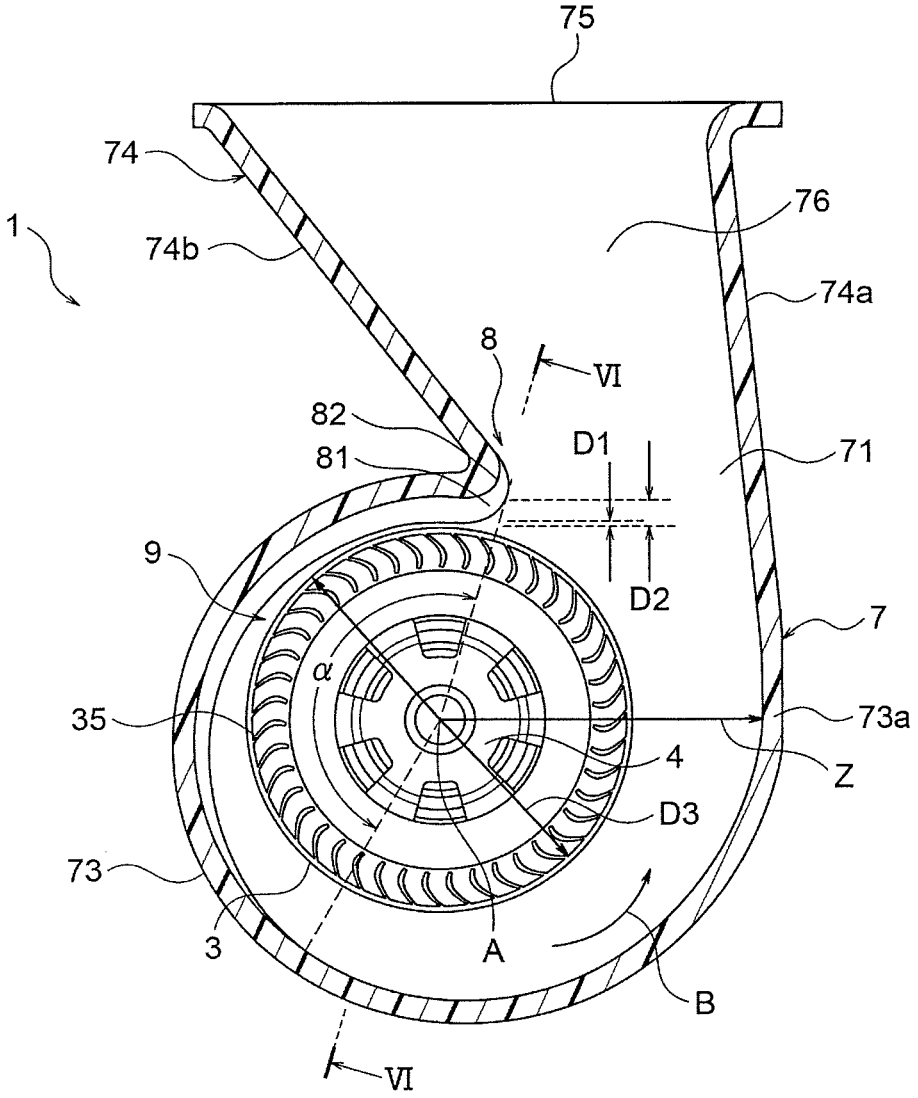
FIG. 3 is a diagram showing an internal configuration of a centrifugal blower according to the first embodiment of the present invention as viewed from an intake side.

FIG. 3 is a diagram showing an internal configuration of the centrifugal blower 1 as viewed from an intake side (the front lower part cover 16*b* side shown in FIG. 1). As shown in FIG. 3, the centrifugal blower 1 includes a centrifugal fan 3, a casing 7 housing the centrifugal fan 3, and a fan motor 4 for rotating the centrifugal fan 3. Incidentally, the casing 7 is also referred to as a scroll casing.

Figure 4:
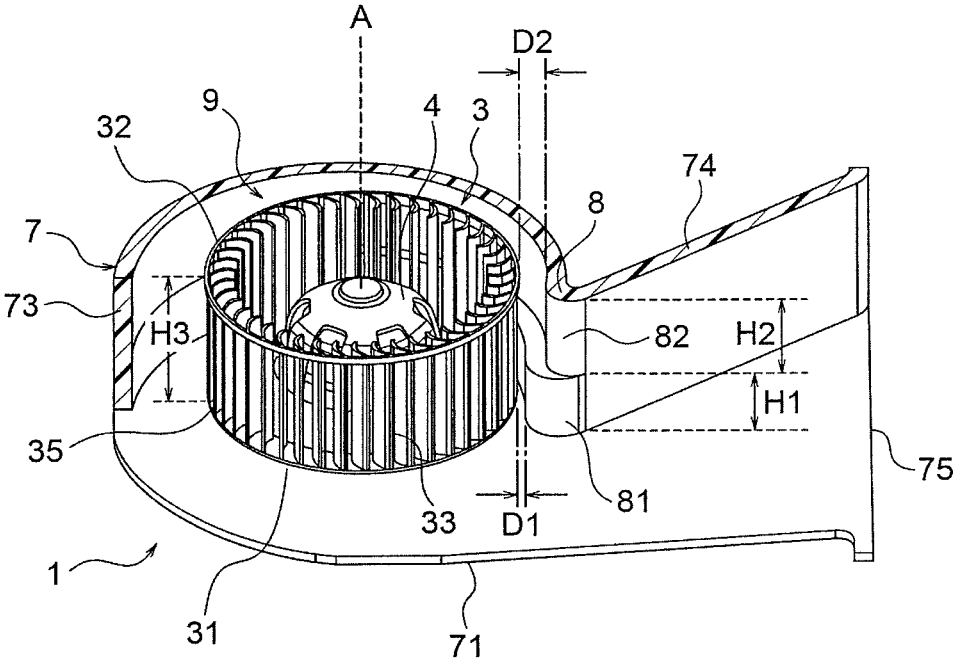
FIG. 4 is a perspective view showing the internal configuration of the centrifugal blower according to the first embodiment of the present invention by removing a side plate and part of a peripheral wall of a casing.
Figure 5:
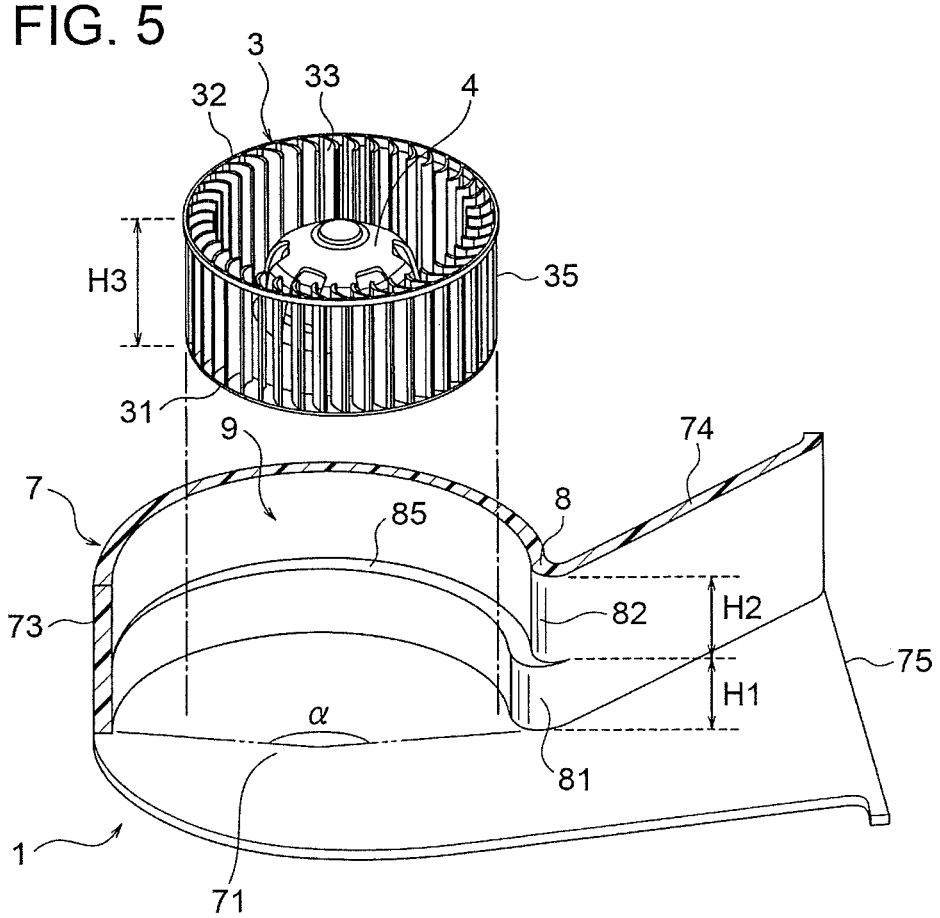
FIG. 5 is an exploded perspective view showing the internal configuration of the centrifugal blower according to the first embodiment of the present invention by detaching a centrifugal fan and a fan motor from the casing shown in FIG. 4.

FIG. 4 is a perspective view showing the internal configuration of the centrifugal blower 1. In FIG. 4, a side plate 72 and part of a peripheral wall 73 which will be described later are removed from the casing 7. FIG. 5 is an exploded perspective view showing the internal configuration of the centrifugal blower 1 by detaching the centrifugal fan 3 and the fan motor 4 from the casing 7 shown in FIG. 4.

As shown in FIG. 4, the centrifugal fan 3 is a multiblade type fan including a ring-shaped main plate 31 and a ring-shaped side plate 32 facing each other in a direction of a rotation axis A, and a plurality of blades 33 disposed between the main plate 31 and the side plate 32. Centers of the main plate 31 and the side plate 32 (both of which are ring-shaped) of the centrifugal fan 3 are located on the rotation axis A. The blades 33 are arranged at equal intervals in a circumferential direction about the rotation axis A of the fan motor 4. Although the centrifugal fan 3 of the multiblade type is described herein, it is also possible to employ a turbo fan.

Figure 6:
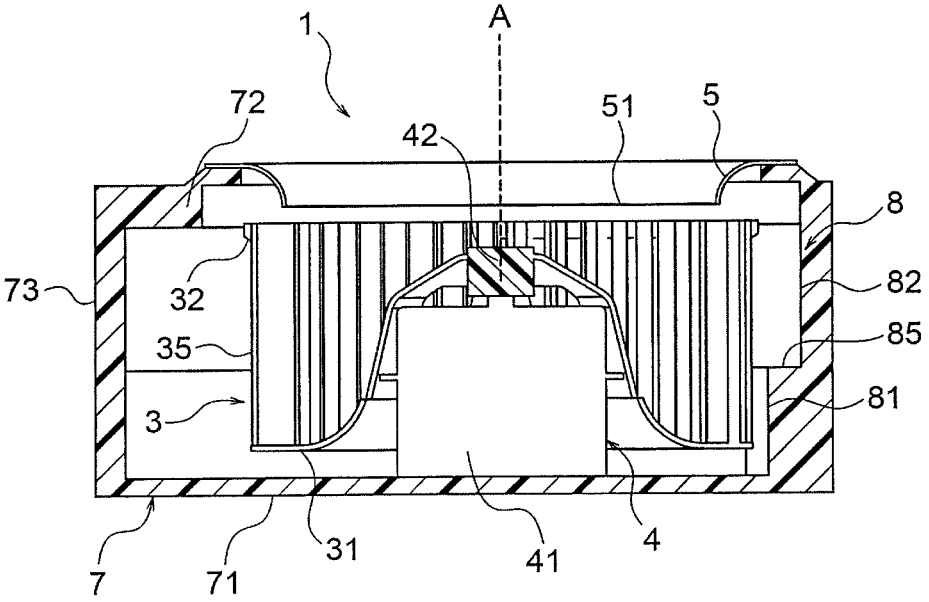
FIG. 6 is a cross-sectional view of the centrifugal blower according to the first embodiment of the present invention at a plane passing through a rotation axis of the centrifugal fan and a tongue portion.

FIG. 6 is a cross-sectional view of the centrifugal blower 1 at a plane passing through the rotation axis A of the centrifugal fan 3 and a tongue portion 8 (described later). In other words, FIG. 6 is a cross-sectional view taken along a line VI-VI in FIG. 3 and viewed in a direction of arrows.

As shown in FIG. 6, the fan motor 4 includes a stator 41 and a rotor 42. The main plate 31 of the centrifugal fan 3 is fixed to the rotor 42. The above described rotation axis A of the centrifugal fan 3 is defined by a rotation axis of the rotor 42 of the fan motor 4. Thus, when the fan motor 4 rotates, the centrifugal fan 3 rotates about the rotation axis A.

The casing 7 includes a main plate 71 and a side plate 72 facing each other in the direction of the rotation axis A of the centrifugal fan 3, and a peripheral wall 73 provided between the main plate 71 and the side plate 72. The main plate 71 of the casing 7 is provided on the main plate 31 side of the centrifugal fan 3. The side plate 72 of the casing 7 is provided on the side plate 32 side (i.e., the intake side) of the centrifugal fan 3. The main plate 71, the side plate 72 and the peripheral wall 73 of the casing 7 may either be formed integrally or configured as a combination of a plurality of components.

The main plate 71 of the casing 7 is formed integrally with the back surface part 15 (FIG. 1) of the housing 11 of the air conditioning apparatus 10, or is attached to the back surface part 15 as a separate component. The stator 41 of the fan motor 4 for driving the centrifugal fan 3 is fixed to the main plate 71 of the casing 7.

As shown in FIG. 3, the peripheral wall 73 of the casing 7 extends in a scroll shape along an outer circumferential edge 35 of the centrifugal fan 3. In the peripheral wall 73 of the casing 7, a tongue portion 8 is provided at a part closest to the outer circumferential edge 35 of the centrifugal fan 3. The tongue portion 8 is a portion as a starting point (a starting position) of the scroll shape of the peripheral wall 73. Further, the tongue portion 8 is also a portion constituting a boundary between the peripheral wall 73 of the casing 7 and a diffuser portion 74 (described later) through which air is blown out to an outside of the casing 7. In other words, the tongue portion 8 is a portion that separates an air flow circulating inside the peripheral wall 73 (around the centrifugal fan 3) and an air flow blown out to the outside of the casing 7 through the diffuser portion 74 from each other.

The peripheral wall 73 is formed so that its distance from the rotation axis A of the centrifugal fan 3 gradually increases in a rotating direction of the centrifugal fan 3 (indicated by an arrow B) from the tongue portion 8 as a starting point. In other words, an air channel between the peripheral wall 73 and the centrifugal fan 3 is gradually enlarged in the rotating direction of the centrifugal fan 3. Incidentally, an increasing rate of the distance between the rotation axis A of the centrifugal fan 3 and the peripheral wall 73 may either be constant or vary from section to section.

The peripheral wall 73 has a terminal end 73*a* as an end position of the scroll shape in an angular range of, for example, 270 degrees to 360 degrees about the rotation axis A of the centrifugal fan 3 from the tongue portion 8 as the starting point. In other words, the peripheral wall 73 extends from the tongue portion 8 to the terminal end 73*a* so that its distance from the rotation axis A increases continuously.

The casing 7 also has the diffuser portion 74. The diffuser portion 74 is a portion through which air blown out from the centrifugal fan 3 is blown out to the outside of the casing 7. The diffuser portion 74 has a wall part 74*a* linearly extending from the terminal end 73*a* of the peripheral wall 73, and a wall part 74*b* linearly extending from the tongue portion 8.

A distance between the wall parts 74*a* and 74*b* of the diffuser portion 74 increases in a direction of an air flow blown out from the centrifugal fan 3. In other words, a width of an air channel 76 formed in the diffuser portion 74 increases in the direction of the air flow blown out from the centrifugal fan 3. An outlet port 75 is formed at a downstream end of the diffuser portion 74. The outlet port 75 is, for example, an opening having a rectangular shape.

As shown in FIG. 6, an intake port 51 is formed in the side plate 72 of the casing 7. The intake port 51 is, for example, a circular opening centered on the rotation axis A of the centrifugal fan 3. When the centrifugal fan 3 rotates, air is taken into the inside of the casing 7 from the intake port 51. A bell mouth 5 is formed along a periphery of the intake port 51. The bell mouth 5 guides the air flow taken in from the intake port 51. The bell mouth 5 is formed integrally with the side plate 72 of the casing 7, or is attached to the side plate 72 as a separate component. Incidentally, a configuration and a mode of the bell mouth 5 are not particularly limited.

In such a configuration, when the centrifugal fan 3 rotates about the rotation axis A, a negative pressure is generated in an inside of the centrifugal fan 3. Due to the negative pressure, air is taken into the inside of the housing 11 from the intake ports 19 (FIG. 1), is guided by the bell mouth 5, and is taken into the inside of the centrifugal fan 3. The air taken into the inside of the centrifugal fan 3 is directed toward an outer circumference of the centrifugal fan 3 due to rotation of the centrifugal fan 3, is further imparted with speed in the rotating direction of the centrifugal fan 3, and is blown out from the centrifugal fan 3.

The air blown out from the centrifugal fan 3 passes through the air channel inside the peripheral wall 73 of the casing 7 and the air channel inside the diffuser portion 74, and is blown out from the outlet port 75. The air blown out from the outlet port 75 of the casing 7 passes through the heat exchanger 6 (FIG. 2), undergoes heat exchange and humidity exchange, and is then blown out from the outlet port 17 to the object space.

(Configuration of Casing)

Next, details of the casing 7 will be described below with reference to FIG. 3 to FIG. 6. As shown in FIG. 4, the above described tongue portion 8 is formed to extend between the main plate 71 and the side plate 72 of the casing 7 in the direction of the rotation axis A of the centrifugal fan 3. In the tongue portion 8, a first part 81 on the main plate 31 side of the centrifugal fan 3 and a second part 82 on the side plate 32 side of the centrifugal fan 3 are formed. Here, the main plate 31 side of the centrifugal fan 3 corresponds to the main plate 71 side of the casing 7, while the side plate 32 side of the centrifugal fan 3 corresponds to the side plate 72 side of the casing 7.

As shown in FIG. 3 and FIG. 4, a distance D1 between the outer circumferential edge 35 of the centrifugal fan 3 and the first part 81 of the tongue portion 8 is smaller than a distance D2 between the outer circumferential edge 35 of the centrifugal fan 3 and the second part 82 of the tongue portion 8 (D1<D2). In other words, the distance between the outer circumferential edge 35 of the centrifugal fan 3 and the tongue portion 8 is smaller on the main plate 31 side of the centrifugal fan 3 than on the side plate 32 side of the centrifugal fan 3.

In other words, on the main plate 31 side of the centrifugal fan 3, the distance between the outer circumferential edge 35 of the centrifugal fan 3 and the tongue portion 8 is reduced, and an air channel width is narrowed. This is for the purpose of restricting the circulating flow, i.e., part of the air blown out from the centrifugal fan 3 passing through a gap between the outer circumferential edge 35 of the centrifugal fan 3 and the tongue portion 8 and circulating inside the casing 7 as described later.

The distance D1 between the outer circumferential edge 35 of the centrifugal fan 3 and the first part 81 and the distance D2 between the outer circumferential edge 35 of the centrifugal fan 3 and the second part 82 preferably satisfy a relationship $D1/D2 \geq 1/3$. This is because when $D1/D2 < 1/3$ is satisfied, an air channel on the main plate 31 side of the centrifugal fan 3 is too narrow as compared with an air channel on the side plate 32 side of the centrifugal fan 3, a wind speed difference due to a difference in the air channel width increases, and a pressure loss increases.

Further, the distance D1 between the outer circumferential edge 35 of the centrifugal fan 3 and the first part 81 and a diameter D3 (FIG. 3) of the centrifugal fan 3 preferably satisfy a relationship $D1/D3 \geq 0.03$. This is because when $D1/D3 < 0.03$ is satisfied, the air channel on the main plate 31 side of the centrifugal fan 3 is too narrow as compared with the diameter D3 of the centrifugal fan 3, and noise due to interference between the air blown out from the centrifugal fan 3 and the tongue portion 8 increases.

As shown in FIG. 5, the first part 81 and the second part 82 extend along an inner circumferential surface of the peripheral wall 73 of the casing 7 from the tongue portion 8. The first part 81 and the second part 82 are formed so that a difference between their distances from the outer circumferential edge 35 of the centrifugal fan 3 decreases continuously in the rotating direction of the centrifugal fan 3. The difference between the distance from the outer circumferential edge 35 of the centrifugal fan 3 to the first part 81 and the distance from the outer circumferential edge 35 of the centrifugal fan 3 to the second part 82 reaches 0 at a position of an angle $\alpha$ about the rotation axis A of the centrifugal fan 3 from the tongue portion 8.

The angle $\alpha$ is larger than or equal to 90 degrees and smaller than or equal to 180 degrees ($90 \leq \alpha \leq 180$) in the example shown in FIG. 3 and FIG. 5. However, the angle $\alpha$ is not limited to such an example and may also be, for example, smaller than or equal to 90 degrees ($0 < \alpha \leq 90$) as an example shown in FIG. 7. A range from the tongue portion 8 to the angle $\alpha$ about the rotation axis A of the centrifugal fan 3 is referred to as a "distance difference setting region 9".

In the distance difference setting region 9, a step part 85 (FIG. 5) is formed between the first part 81 and the second part 82. As an angle about the rotation axis A of the centrifugal fan 3 from the tongue portion 8 increases, a width of the step part 85 decreases and reaches 0 when the angle reaches the angle $\alpha$.

As shown in FIG. 4 and FIG. 5, in the direction of the rotation axis A of the centrifugal fan 3, the first part 81 has a dimension (height) H1 and the second part 82 has a dimension H2. Further, in the same direction, the centrifugal fan 3 has a dimension H3.

The dimension H1 of the first part 81 is preferably smaller than or equal to ½ of the dimension H3 of the centrifugal fan 3. Further, the dimensions H1 and H2 of the first part 81 and the second part 82 are preferably constant throughout the distance difference setting region 9 starting from the tongue portion 8. These are for the purpose of reducing curling up of a blow-out flow of the centrifugal fan 3 from the main plate 31 side toward the side plate 32 side.

(Operation)

In the centrifugal blower 1, most of the air blown out from the centrifugal fan 3 flows along the peripheral wall 73 of the casing 7, passes through the diffuser portion 74, and is blown out from the outlet port 75. However, part of the air blown out from the centrifugal fan 3 passes through the gap between the outer circumferential edge 35 of the centrifugal fan 3 and the tongue portion 8 without being directed toward the diffuser portion 74, and circulates inside the peripheral wall 73 again. In other words, the circulating flow occurs. In particular, a blow-out wind speed of the centrifugal fan 3 is higher on the main plate 31 side than on the side plate 32 side, and therefore a flow rate of the circulating flow in the casing 7 is higher in a region closer to the main plate 31.

Therefore, in this first embodiment, the distance between the outer circumferential edge 35 of the centrifugal fan 3 and the tongue portion 8 (i.e., the first part 81) is reduced on the main plate 31 side of the centrifugal fan 3. With this configuration, the flow rate passing through between the outer circumferential edge 35 of the centrifugal fan 3 and the tongue portion 8 on the main plate 31 side of the centrifugal fan 3 is reduced, and the circulating flow in the casing 7 is reduced. Further, when the distance between the outer circumferential edge 35 of the centrifugal fan 3 and the tongue portion 8 is reduced on both the main plate 31 side and the side plate 32 side, the circulating flow decreases, but noise (wind noise) increases since the outer circumferential edge 35 of the centrifugal fan 3 and the tongue portion 8 are close to each other. In this embodiment, the wind noise is restricted by reducing the distance between the outer circumferential edge 35 of the centrifugal fan 3 and the tongue portion 8 only on the main plate 31 side where the blow-out wind speed of the centrifugal fan 3 is high.

Further, while the blow-out wind speed of the centrifugal fan 3 is lower on the side plate 32 side than on the main plate 31 side, ventilation resistance on the side plate 32 side of the centrifugal fan 3 is low since the distance between the outer circumferential edge 35 of the centrifugal fan 3 and the tongue portion 8 is larger on the side plate 32 side than on the main plate 31 side as described above. Therefore, it is possible to increase the blow-out wind speed of the centrifugal fan 3 on the side plate 32 side and thereby equalize a distribution of the blow-out wind speed of the centrifugal fan 3 between the main plate 31 side and the side plate 32 side. Accordingly, occurrence of vortex due to the wind speed difference between the main plate 31 side and the side plate 32 side of the centrifugal fan 3 is restricted, and the noise is reduced.

Furthermore, since the circulating flow in the casing 7 is reduced as described above, a blow-out flow rate from the casing 7 can be increased and a rotation speed of the centrifugal fan 3 required for achieving the same blow-out flow rate can be reduced, and therefore the efficiency can be enhanced and the noise can be reduced.

Further, in this first embodiment, the increasing rate of the distance between the rotation axis A of the centrifugal fan 3 and the peripheral wall 73 of the casing 7 is higher on the main plate 31 side of the centrifugal fan 3 than on the side plate 32 side of the centrifugal fan 3. This point will be described below with reference to FIG. 3.

As described above, the distance between the outer circumferential edge 35 of the centrifugal fan 3 and the first part 81 is represented by D1, and the distance between the outer circumferential edge 35 of the centrifugal fan 3 and the second part 82 is represented by D2. Furthermore, a radius of the centrifugal fan 3 is represented by R (=D3/2). In this case, the distance between the rotation axis A of the centrifugal fan 3 and the tongue portion 8 (the first part 81) on the main plate 31 side of the centrifugal fan 3 is represented by D1+R. Further, the distance between the rotation axis A of the centrifugal fan 3 and the tongue portion 8 (the second part 82) on the side plate 32 side of the centrifugal fan 3 is represented by D2+R.

On the main plate 31 side of the centrifugal fan 3, the distance between the rotation axis A of the centrifugal fan 3 and the peripheral wall 73 increases from D1+R to Z in a section from the tongue portion 8 to the terminal end 73*a*, where Z represents a distance between the rotation axis A of the centrifugal fan 3 and the terminal end 73*a* of the peripheral wall 73 (the end position of the scroll shape). Similarly, on the side plate 32 side of the centrifugal fan 3, the distance between the rotation axis A of the centrifugal fan 3 and the peripheral wall 73 increases from D2+R to Z in the section from the tongue portion 8 to the terminal end 73*a*.

Therefore, the increasing rate of the distance between the rotation axis A of the centrifugal fan 3 and the peripheral wall 73 is {Z−(D1+R)}/Z on the main plate 31 side of the centrifugal fan 3, and is {Z−(D2+R)}/Z on the side plate 32 side of the centrifugal fan 3. Incidentally, a denominator used for calculating the increasing rate need only be a distance usable as a reference, and is not limited to the distance Z.

As described above, since the distance D1 is smaller than the distance D2, the increasing rate of the distance between the rotation axis A of the centrifugal fan 3 and the peripheral wall 73 on the main plate 31 side is higher than the increasing rate of the distance between the rotation axis A of the centrifugal fan 3 and the peripheral wall 73 on the side plate 32 side.

In this way, since the increasing rate of the distance between the rotation axis A of the centrifugal fan 3 and the peripheral wall 73 is higher on the main plate 31 side of the centrifugal fan 3, an enlargement rate of the air channel width between the outer circumferential edge 35 of the centrifugal fan 3 and the peripheral wall 73 becomes higher on the main plate 31 side of the centrifugal fan 3. With this configuration, on the main plate 31 side of the centrifugal fan 3, an increase in ventilation resistance due to nearness between the outer circumferential edge 35 of the centrifugal fan 3 and the tongue portion 8 can be restricted by the above described enlargement of the air channel width.

Figure 8:
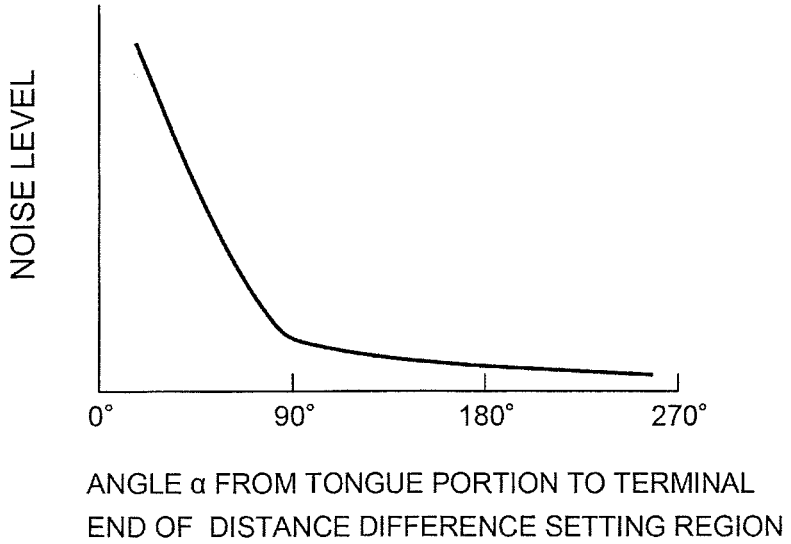
FIG. 8 is a diagram showing a relationship between a range of a distance difference setting region and a noise level in the centrifugal blower according to the first embodiment of the present invention.

Next, a range of the distance difference setting region 9 will be described below. FIG. 8 is a diagram showing a simulation result of a change in noise (wind noise) examined by changing the distance difference setting region 9. A horizontal axis in FIG. 8 represents the angle α from the tongue portion 8 to a terminal end of the distance difference setting region 9 about the rotation axis A of the centrifugal fan 3. A vertical axis in FIG. 8 represents a noise level. The noise decreases significantly with an increase in the angle α when the angle α is increased from 0 degrees to 90 degrees, but a degree of decrease in noise becomes smaller when the angle α exceeds 90 degrees.

Figure 7:
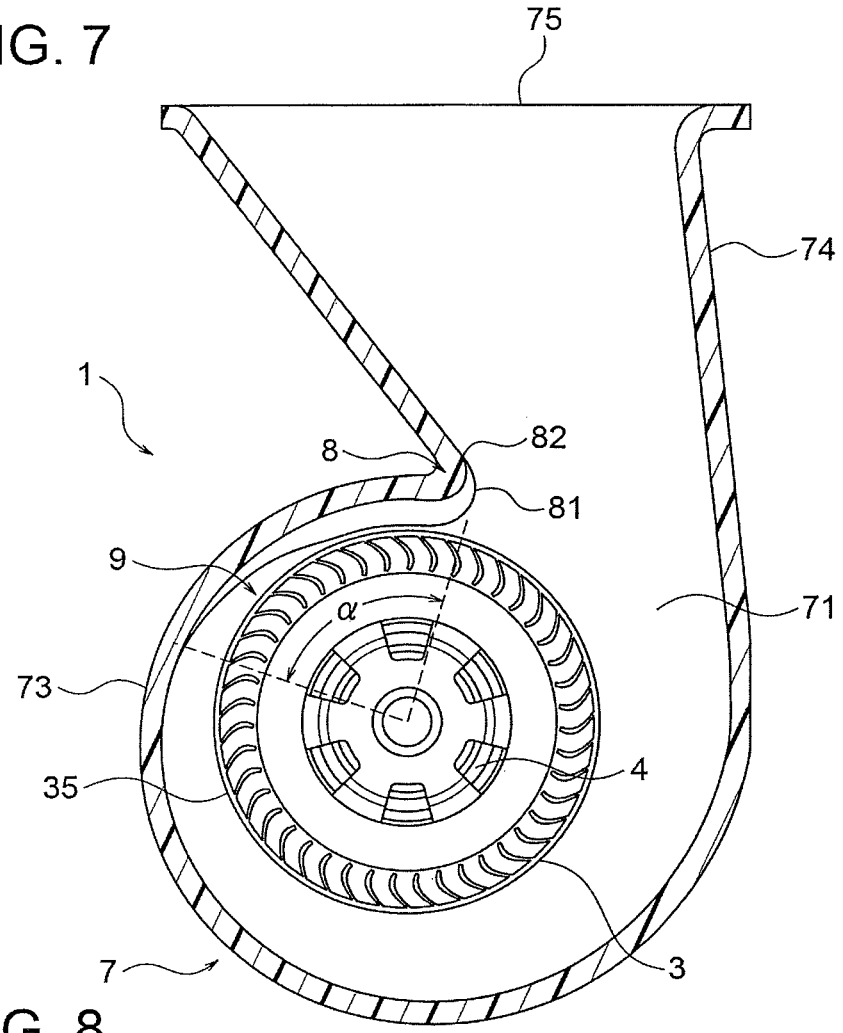
FIG. 7 is a diagram showing the internal configuration of the centrifugal blower according to the first embodiment of the present invention as viewed from the intake side.

Thus, the angle α from the tongue portion 8 to the terminal end of the distance difference setting region 9 is preferably smaller than or equal to 90 degrees as an example shown in FIG. 7. When the angle α is smaller than or equal to 90 degrees as above, the distance between the rotation axis A of the centrifugal fan 3 and the peripheral wall 73 of the casing 7 becomes the same on the main plate 31 side and on the side plate 32 side at a position where the angle α from the tongue portion 8 is 90 degrees. Thus, it is unnecessary to enlarge a width of the casing 7 (a dimension in a lateral direction in FIG. 3). In other words, the efficiency can be enhanced and the noise can be reduced without enlarging a width of the centrifugal blower 1.

Figure 9:
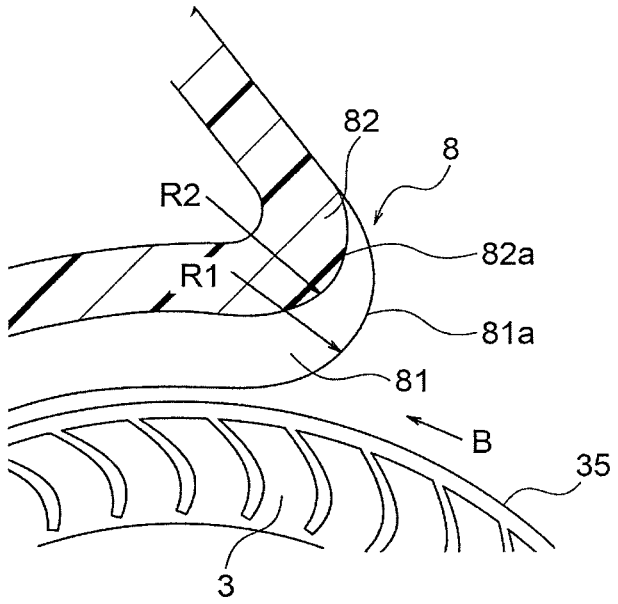
FIG. 9 is a schematic diagram showing a shape of an upstream end of the tongue portion of the centrifugal blower according to the first embodiment of the present invention.

Next, a shape of the tongue portion 8 and its function will be described below. FIG. 9 is a schematic diagram showing the shape of the tongue portion 8 as viewed in the direction of the rotation axis A of the centrifugal fan 3. The first part 81 and the second part 82 of the tongue portion 8 respectively have curved surface portions 81*a* and 82*a* protruding toward the centrifugal fan 3 at their upstream ends in the rotating direction of the centrifugal fan 3 (indicated by the arrow B in the figure). In other words, the tongue portion 8 has the curved surface portion 81*a* on the main plate 31 side of the centrifugal fan 3 (i.e., the main plate 71 side of the casing 7) and the curved surface portion 82*a* on the side plate 32 side of the centrifugal fan 3 (i.e., the side plate 72 side of the casing 7) at its upstream end in the rotating direction of the centrifugal fan 3.

A curvature radius R1 of the curved surface portion 81*a* of the first part 81 (i.e., the curved surface portion on the main plate 31 side of the centrifugal fan 3) is larger than a curvature radius R2 of the curved surface portion 82*a* of the second part 82 (i.e., the curved surface portion on the side plate 32 side of the centrifugal fan 3). In other words, the curvature radius of the upstream end of the tongue portion 8 in the rotating direction of the centrifugal fan 3 is larger as the distance from the outer circumferential edge 35 of the centrifugal fan 3 is smaller.

On the main plate 31 side of the centrifugal fan 3 (i.e., the main plate 71 side of the casing 7), the distance between the outer circumferential edge 35 of the centrifugal fan 3 and the tongue portion 8 is small, and therefore the wind speed at the gap between the outer circumferential edge 35 of the centrifugal fan 3 and the tongue portion 8 increases. Here, the curvature radius R1 of the curved surface portion 81*a* of the first part 81 of the tongue portion 8 is larger than the curvature radius R2 of the curved surface portion 82*a* of the second part 82, and therefore separation of an air stream is less likely to occur even when the wind speed at the gap between the outer circumferential edge 35 of the centrifugal fan 3 and the tongue portion 8 increases on the main plate 31 side of the centrifugal fan 3. Consequently, occurrence of vortex due to the separation of the air stream can be restricted, and the noise caused by the occurrence of vortex can be reduced.

Incidentally, the ratio R1/R2 between the curvature radius R1 of the curved surface portion 81*a* of the first part 81 and the curvature radius R2 of the curved surface portion 82*a* of the second part 82 of the tongue portion 8 is preferably smaller than or equal to 3 (R1/R2≤3). This is because when R1/R2 is larger than 3, pressure loss due to collision of the air stream with the upstream end of the tongue portion 8 may occur.

Effect of Embodiment

As described above, in the first embodiment of the present invention, the distance between the outer circumferential edge 35 of the centrifugal fan 3 and the tongue portion 8 is smaller on the main plate 31 side of the centrifugal fan 3 than on the side plate 32 side of the centrifugal fan 3. Thus, the circulating flow in the casing 7 can be reduced by reducing the distance between the outer circumferential edge 35 of the centrifugal fan 3 and the tongue portion 8 on the main plate 31 side of the centrifugal fan 3, and the noise can be reduced by securing a distance between the outer circumferential edge 35 of the centrifugal fan 3 and the tongue portion 8 on the side plate 32 side of the centrifugal fan 3. Thus, the noise can be reduced, and the efficiency can be enhanced.

Further, since the distance between the rotation axis A of the centrifugal fan 3 and the peripheral wall 73 of the casing 7 increases in the rotating direction of the centrifugal fan 3 from the tongue portion 8 as the starting point, the air channel width between the outer circumferential edge 35 of the centrifugal fan 3 and the peripheral wall 73 of the casing 7 gradually increases in the rotating direction of the centrifugal fan 3. Accordingly, the air blown out from the centrifugal fan 3 can be delivered to the diffuser portion 74 after conversion from dynamic pressure to static pressure.

Furthermore, since the increasing rate of the distance between the rotation axis A of the centrifugal fan 3 and the peripheral wall 73 of the casing 7 is higher on the main plate 31 side of the centrifugal fan 3 than on the side plate 32 side of the centrifugal fan 3, the increase in the ventilation resistance due to nearness between the outer circumferential edge 35 of the centrifugal fan 3 and the tongue portion 8 on the main plate 31 side can be restricted by the enlargement of the air channel width on the main plate 31 side of the centrifugal fan 3. Accordingly, the efficiency can be further enhanced.

Further, the tongue portion 8 includes the first part 81 on the main plate 31 side of the centrifugal fan 3 and the second part 82 on the side plate 32 side of the centrifugal fan 3, the distance between the outer circumferential edge 35 of the centrifugal fan 3 and the first part 81 is smaller than the distance between the outer circumferential edge 35 of the centrifugal fan 3 and the second part 82, and the first part 81 has a certain length H1 in the direction of the rotation axis A of the centrifugal fan 3. Therefore, it is possible to restrict curling up of the blow-out flow of the centrifugal fan 3 from the main plate 31 side toward the side plate 32 side.

Further, in the range (the distance difference setting region 9) of a certain angle α about the rotation axis A of the centrifugal fan 3 from the tongue portion 8 as the staring point, the distance between the outer circumferential edge 35 of the centrifugal fan 3 and the peripheral wall 73 of the casing 7 is smaller on the main plate 31 side of the centrifugal fan 3 than on the side plate 32 side of the centrifugal fan 3. Therefore, a sufficient distance between the outer circumferential edge 35 of the centrifugal fan 3 and the peripheral wall 73 of the casing 7 can be secured on the side plate 32 side of the centrifugal fan 3. Accordingly, the occurrence of the wind noise can be further restricted.

In particular, by setting the above described angle α smaller than or equal to 90 degrees, the noise can be reduced while avoiding enlargement of the centrifugal blower 1.

Further, since the distance D1 between the outer circumferential edge 35 of the centrifugal fan 3 and the tongue portion 8 on the main plate 31 side of the centrifugal fan 3 and the distance D2 between the outer circumferential edge 35 of the centrifugal fan 3 and the tongue portion 8 on the side plate 32 side of the centrifugal fan 3 satisfy the relationship D1/D2≥⅓, the increase in wind speed difference caused by the difference in the air channel width can be restricted, and the increase in pressure loss can be restricted.

Further, since the distance D1 between the outer circumferential edge 35 of the centrifugal fan 3 and the tongue portion 8 on the main plate 31 side of the centrifugal fan 3 and the diameter D3 of the centrifugal fan 3 satisfy the relationship D1/D3≥0.03, the occurrence of the noise caused by the interference between the air blown out from the centrifugal fan 3 and the tongue portion 8 can be restricted.

Further, since the upstream end of the tongue portion 8 in the rotating direction of the centrifugal fan 3 has the curved surface portions 81*a* and 82*a* protruding toward the centrifugal fan 3, the occurrence of the noise caused by the collision of the air stream blown out from the centrifugal fan 3 can be reduced.

Especially, the curvature radii R1 and R2 of the curved surface portions 81*a* and 82*a* of the tongue portion 8 are so set that the curvature radius on the main plate 31 side of the centrifugal fan 3 (i.e., the curvature radius R1) is larger than the curvature radius on the side plate side of the centrifugal fan 3 (i.e., the curvature radius R2). Therefore, the separation of the air stream is less likely to occur and the noise caused by the occurrence of vortex due to the separation of the air stream can be reduced, even if the wind speed at the gap between the outer circumferential edge 35 of the centrifugal fan 3 and the tongue portion 8 increases on the main plate 31 side of the centrifugal fan 3.

Further, the curvature radii of the curved surface portions 81*a*, 82*a* of the tongue portion 8 are so set that the curvature radius R1 on the main plate 31 side of the centrifugal fan 3 and the curvature radius R2 on the side plate 32 side of the centrifugal fan 3 satisfy the relationship R1/R2≤3, and therefore the pressure loss caused by the collision of the air stream with the upstream end of the tongue portion 8 can be restricted.

Second Embodiment

Figure 10:
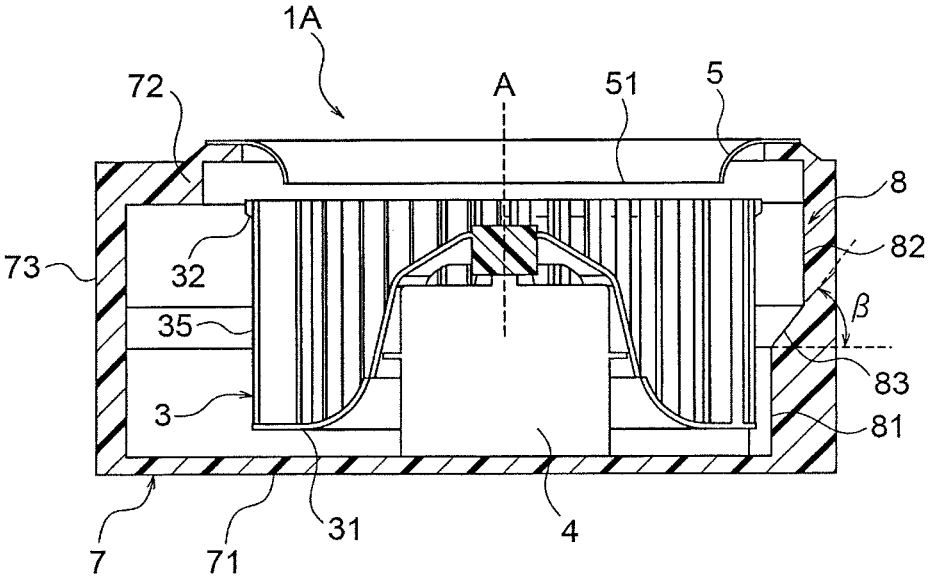
FIG. 10 is a cross-sectional view of a centrifugal blower according to a second embodiment of the present invention at a plane passing through a rotation axis of a centrifugal fan and a tongue portion.

Next, a second embodiment of the present invention will be described below with reference to FIG. 10. FIG. 10 is a cross-sectional view showing a configuration of a centrifugal blower 1A according to the second embodiment. FIG. 10 corresponds to a cross-sectional view taken along a line VI-VI in FIG. 3 and viewed in a direction of arrows. In FIG. 10, components identical to those in the first embodiment are assigned the same reference characters as in the first embodiment.

In the second embodiment, a boundary portion 83 between the first part 81 and the second part 82 of the tongue portion 8 is inclined with respect to a plane perpendicular to the rotation axis A of the centrifugal fan 3. More specifically, the boundary portion 83 is configured so that the distance between the outer circumferential edge 35 of the centrifugal fan 3 and the tongue portion 8 increases continuously from the main plate 31 side toward the side plate 32 side of the centrifugal fan 3 (i.e., from the main plate 71 side towards the side plate 72 side of the casing 7).

In the second embodiment, the boundary portion 83 is configured so that the distance between the outer circumferential edge 35 of the centrifugal fan 3 and the tongue portion 8 increases continuously from the main plate 31 side toward the side plate 32 side of the centrifugal fan 3, and therefore the change in the distance between the outer circumferential edge 35 of the centrifugal fan 3 and the tongue portion 8 becomes gradual. In other words, the change in the air channel width between the outer circumferential edge 35 of the centrifugal fan 3 and the tongue portion 8 becomes gradual.

In a portion where the air channel width changes sharply, noise may occur due to a wind speed difference of the air flowing through the air channel, and pressure loss may occur. In this second embodiment, since the air channel width gradually changes in the boundary portion 83, the noise due to the wind speed difference can be reduced and the pressure loss can be restricted.

An inclination angle β of the boundary portion 83 with respect to the plane perpendicular to the rotation axis A of the centrifugal fan 3 is preferably larger than or equal to 60 degrees. This is because, when the inclination angle β of the boundary portion 83 is smaller than 60 degrees, the enlargement of the air channel width in the boundary portion 83 may cause an air stream to curl up from the main plate 31 side toward the side plate 32 side of the centrifugal fan 3 and may lead to separation of the air stream.

Incidentally, the boundary portion 83 is preferably provided to extend from the tongue portion 8 as the starting point and throughout the distance difference setting region 9 (see FIG. 3) of the peripheral wall 73. While the boundary portion 83 is shown as an inclined portion having a straight shape in FIG. 10, the boundary portion 83 may also have, for example, a curved shape. Further, while the centrifugal blower having a single suction structure is shown in FIG. 10, the second embodiment is also applicable to a centrifugal blower having a double structure (see FIG. 13) which will be described later.

As described above, in the second embodiment of the present invention, there is provided the boundary portion 83 in which the distance between the outer circumferential edge 35 of the centrifugal fan 3 and the tongue portion 8 increases continuously from the main plate 31 side toward the side plate 32 side of the centrifugal fan 3. Accordingly, the change in the air channel width between the outer circumferential edge 35 of the centrifugal fan 3 and the tongue portion 8 can be made gradual, and the wind speed difference due to the change in the air channel width can be reduced. Thus, the efficiency can be further enhanced and the noise can be further reduced, in addition to the effects described in the first embodiment.

Further, since the inclination angle β of the boundary portion 83 with respect to the plane perpendicular to the rotation axis A of the centrifugal fan 3 is larger than or equal to 60 degrees, the curling up of the air stream from the main plate 31 side toward the side plate 32 side of the centrifugal fan 3 can be restricted, and the noise caused by the curling up of the air stream can be reduced.

Third Embodiment

Figure 11:
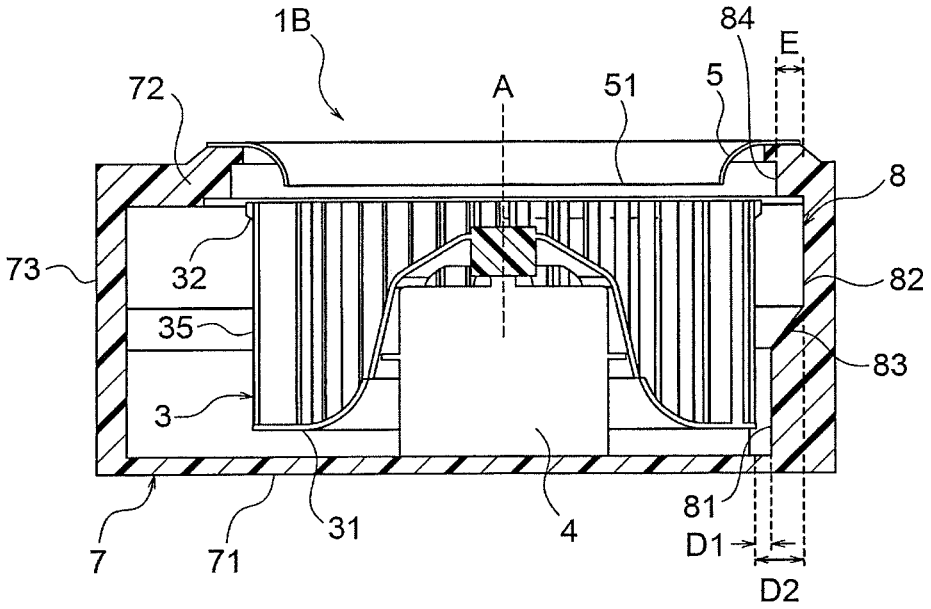
FIG. 11 is a cross-sectional view of a centrifugal blower according to a third embodiment of the present invention at a plane passing through a rotation axis of a centrifugal fan and a tongue portion.

Next, a third embodiment of the present invention will be described below with reference to FIG. 11. FIG. 11 is a cross-sectional view showing a configuration of a centrifugal blower 1B according to the third embodiment. FIG. 11 corresponds to a cross-sectional view taken along the line VI-VI in FIG. 3 and viewed in the direction of arrows. In FIG. 11, components identical to those in the first embodiment are assigned the same reference characters as in the first embodiment.

In the third embodiment, the tongue portion 8 has a distance-reducing portion 84 located on the side plate 72 side (i.e., the intake side) of the casing 7 with respect to the centrifugal fan 3 in the direction of the rotation axis A of the centrifugal fan 3. The distance between the outer circumferential edge 35 of the centrifugal fan 3 and the distance-reducing portion 84 is smaller than the distance between the outer circumferential edge 35 of the centrifugal fan 3 and the second part 82. In other words, the distance-reducing portion 84 projects toward the centrifugal fan 3 with respect to the second part 82.

By providing the distance-reducing portion 84, an air channel on the intake side (an upper side in FIG. 11) with respect to the centrifugal fan 3 is narrowed. With this configuration, the circulating flow in the casing 7 can be further reduced. Further, an influence on the blow-out flow from the centrifugal fan 3 is very small. The distance-reducing portion 84 is provided to extend from the tongue portion 8 as the starting point and throughout the distance difference setting region 9 (see FIG. 3) of the peripheral wall 73.

It is preferable that a relationship E≤D2−D1 is satisfied among a distance E between the second part 82 and the distance-reducing portion 84 in the radial direction of the centrifugal fan 3, the distance D1 between the outer circumferential edge 35 of the centrifugal fan 3 and the first part 81, and the distance D2 between the outer circumferential edge 35 of the centrifugal fan 3 and the second part 82. This is because, by setting the distance E smaller than or equal to the difference (D2−D1) between the distances D1 and D2, collision between the centrifugal fan 3 and the casing 7 due to whirling of the centrifugal fan 3 can be securely prevented.

Incidentally, although an inclined boundary portion similar to that in the second embodiment is provided between the first part 81 and the second part 82 in FIG. 11, it is also possible to provide a step part 85 (see FIG. 6) perpendicular to the rotation axis A of the centrifugal fan 3 instead of the inclined boundary portion 83. Further, although the centrifugal blower having the single suction structure is shown in FIG. 11, the third embodiment is also applicable to the centrifugal blower having the double suction structure (see FIG. 13) which will be described later.

As described above, in the third embodiment of the present invention, the distance between the outer circumferential edge 35 of the centrifugal fan 3 and the tongue portion 8 is reduced on the side plate 72 side of the casing 7 with respect to the centrifugal fan 3. Accordingly, the circulating flow in the casing 7 can be reduced without influencing the blow-out flow of the centrifugal fan 3. Thus, the efficiency can be further enhanced and the noise can be further reduced, in addition to the effects described in the first embodiment.

Further, since the relationship E≤D2−D1 is satisfied among the distance E between the second part 82 and the distance-reducing portion 84 in the radial direction of the centrifugal fan 3, the distance D1 between the outer circumferential edge 35 of the centrifugal fan 3 and the first part 81, and the distance D2 between the outer circumferential edge 35 of the centrifugal fan 3 and the second part 82, the collision between the centrifugal fan 3 and the casing 7 due to the whirling of the centrifugal fan 3 can be prevented.

Fourth Embodiment

Figure 12:
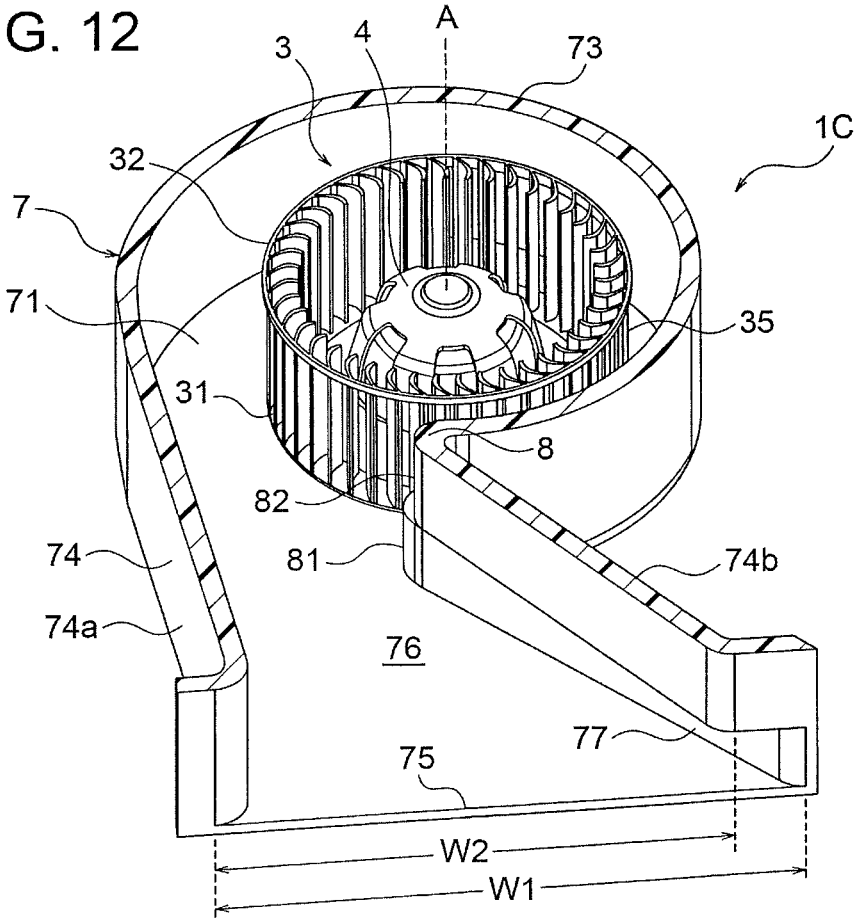
FIG. 12 is a perspective view showing an internal configuration of a centrifugal blower according to a fourth embodiment of the present invention.

Next, a fourth embodiment of the present invention will be described below with reference to FIG. 12. FIG. 12 is a perspective view showing an internal configuration of a centrifugal blower 1C according to the fourth embodiment as viewed from the outlet port 75 side. In FIG. 12, the side plate 72 of the casing 7 is removed to show the internal configuration of the centrifugal blower 1C. In FIG. 12, components identical to those in the first embodiment are assigned the same reference characters as in the first embodiment.

As described above, the casing 7 has the diffuser portion 74 forming the air channel 76 reaching the outlet port 75. In the fourth embodiment, an enlarging portion 77 that increases a width of the air channel 76 is formed on the main plate 71 side of the diffuser portion 74 (i.e., the main plate 31 side of the centrifugal fan 3).

In the air channel 76 of the diffuser portion 74, a flow rate flowing on the main plate 71 side is higher than a flow rate flowing on the side plate 72 side. In this fourth embodiment, the width of the diffuser portion 74 is increased by providing the enlarging portion 77 on the main plate 71 side where the flow rate is high. Especially, since the flow rate in the diffuser portion 74 increases due to the reduction in the circulating flow described in the first embodiment, the pressure loss is recovered by the enlargement of the air channel width.

Further, if the width of the diffuser portion 74 is increased on the side plate 72 side where the flow rate is low, an air stream may fail to flow along the wall part 74*a* of the diffuser portion 74, and separation of the air stream may occur. In the fourth embodiment, since the width of the diffuser portion 74 is increased only on the main plate 71 side where the flow rate is high, the ventilation resistance is restricted, and the separation of the air stream is restricted.

In this example, the width W1 of the diffuser portion on the main plate 71 side and the width W2 of the diffuser portion 74 on the side plate 72 side are set so that the ratio (W1/W2) between the widths W1 and W2 is smaller than 1.1. This is because, when W1/W2 is larger than or equal to 1.1, the width excessively increases on the main plate 71 side of the diffuser portion 74 and leads to the separation of the air stream.

In this example, the diffuser portion 74 has the wall parts 74*a* and 74*b*, and the enlarging portion 77 is provided in the wall part 74*b* connected to the tongue portion 8. However, it is also possible to provide the enlarging portion 77 in the other wall part 74*a* or in both of the wall parts 74*a* and 74*b*.

The enlarging portion 77 is formed so that its position and dimension in the direction of the rotation axis A of the centrifugal fan 3 are equal to those of the first part 81 of the tongue portion 8. In other words, a range in which the width of the diffuser portion 74 is increased and a range in which the distance between the outer circumferential edge 35 of the centrifugal fan 3 and the tongue portion 8 is reduced coincide with each other in the direction of the rotation axis A of the centrifugal fan 3. In other words, in the direction of the rotation axis A of the centrifugal fan 3, a part where a change in width of the diffuser portion 74 reaches its maximum and a part where a change in distance between the outer circumferential edge 35 of the centrifugal fan 3 and the tongue portion 8 reaches its maximum coincide with each other.

Incidentally, while the centrifugal blower having the single suction structure is shown in FIG. 12, the fourth embodiment is also applicable to the centrifugal blower having the double suction structure (see FIG. 13) which will be described later. In this case, the enlarging portion 77 is provided in a center part of the diffuser portion 74 in the direction of the rotation axis A of the centrifugal fan 3 (i.e., the main plate 31 side of the centrifugal fan 3).

As described above, in the fourth embodiment of the present invention, the width of the diffuser portion 74 of the casing 7 is increased on the main plate 31 side of the centrifugal fan 3. Accordingly, even when the flow rate in the diffuser portion 74 increases due to the reduction in the circulating flow, the pressure loss can be recovered by the enlargement of the air channel width. Thus, the efficiency can be further enhanced, in addition to the effects described in the first embodiment.

Further, since the ratio (W1/W2) between the width W1 of the diffuser portion 74 on the main plate 71 side and the width W2 of the diffuser portion 74 on the side plate side is smaller than 1.1, the width of the diffuser portion 74 does not excessively increase on the main plate 71 side, and the noise caused by the separation of the air stream can be restricted.

Fifth Embodiment

In the above first to fourth embodiments, description has been given of the centrifugal blowers of the single suction type each of which has one intake port 51 and takes in air from one side of the centrifugal fan 3. However, each of the embodiments is also applicable to a centrifugal blower of the double suction type having two intake ports 51 and taking in air from both sides of the centrifugal fan 3.

Figure 13:
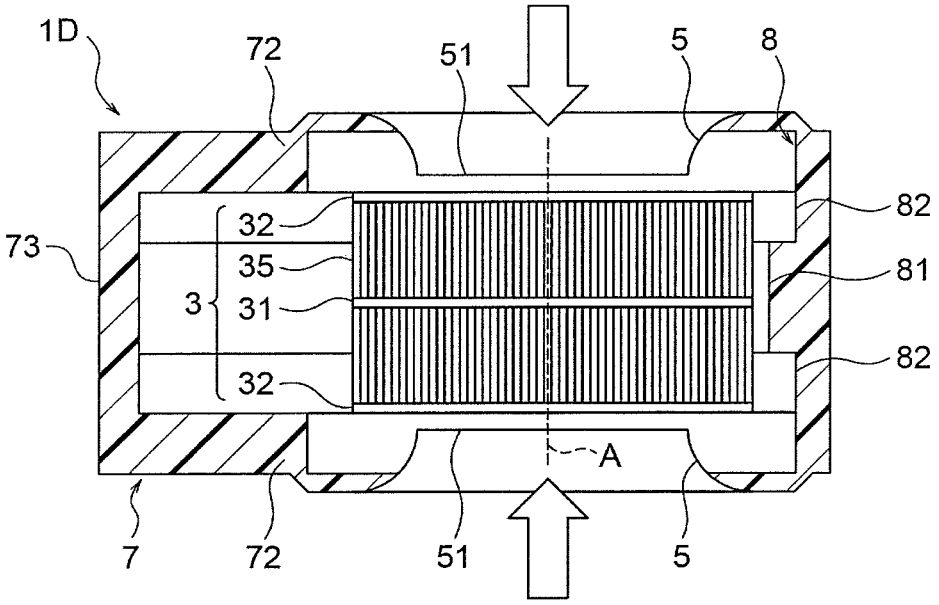
FIG. 13 is a schematic diagram showing a centrifugal blower according to a fifth embodiment of the present invention.

FIG. 13 is a cross-sectional view showing a centrifugal blower 1D according to a fifth embodiment. The centrifugal blower 1D of the fifth embodiment is an example in which the first embodiment is applied to the centrifugal blower of the double suction type. In FIG. 13, components identical to those in the first embodiment are assigned the same reference characters as in the first embodiment.

The casing 7 of the centrifugal blower 1D according to the fifth embodiment includes two side plates 72 facing each other in the direction of the rotation axis A of the centrifugal fan 3, but includes no main plate 71. Each of the two side plates 72 is provided with an intake port 51. A bell mouth 5 is provided on a periphery of each intake port 51.

The centrifugal fan 3 includes the main plate 31 in a center part in the direction of the rotation axis A, and the side plates 32 in each of the two end parts in the direction of the rotation axis A. The rotor 42 (FIG. 6) of the fan motor 4 (hidden inside the centrifugal fan 3 in FIG. 13) is connected to the main plate 31 of the centrifugal fan 3. When the centrifugal fan 3 rotates, a negative pressure is generated in the centrifugal fan 3 and air is taken in from the intake ports 51 of the two side plates 72 of the casing 7.

The tongue portion 8 of the casing 7 includes a first part 81 in a center part (i.e., the main plate 31 side of the centrifugal fan 3) in the direction of the rotation axis A of the centrifugal fan 3, and a second part 82 in each of the two end parts (i.e., each side plate 32 side of the centrifugal fan 3) in the direction of the rotation axis A of the centrifugal fan 3.

As described in the first embodiment, the distance between the outer circumferential edge 35 of the centrifugal fan 3 and the first part 81 of the tongue portion 8 is smaller than the distance between the outer circumferential edge 35 of the centrifugal fan 3 and the second part 82 of the tongue portion 8. In other words, the distance between the outer circumferential edge 35 of the centrifugal fan 3 and the tongue portion 8 is smaller on the main plate 31 side of the centrifugal fan 3 than on the side plate 32 side of the centrifugal fan 3.

In the centrifugal blower 1D of the double suction type, the blow-out speed is the highest in the center part in the direction of the rotation axis A of the centrifugal fan 3. In this fifth embodiment, the air channel width between the outer circumferential edge 35 of the centrifugal fan 3 and the tongue portion 8 is narrowed in the center part (i.e., the main plate 31 side of the centrifugal fan 3) in the direction of the rotation axis A of the centrifugal fan 3 where the blow-out speed is the highest. With this configuration, the circulating flow in the casing 7 can be reduced. Further, an air channel width between the outer circumferential edge 35 of the centrifugal fan 3 and the tongue portion 8 is secured in each of the two end parts (i.e., each side plate 32 side of the centrifugal fan 3) in the direction of the rotation axis A of the centrifugal fan 3, and therefore noise can be reduced.

Furthermore, since the increasing rate of the distance between the rotation axis A of the centrifugal fan 3 and the peripheral wall 73 is higher in the center part (i.e., on the main plate 31 side of the centrifugal fan 3) than in each of the two end parts (i.e., on each side plate side of the centrifugal fan 3) in the rotation axis direction of the centrifugal fan 3, the increase in the ventilation resistance can be restricted.

As described above, according to the fifth embodiment of the present invention, the centrifugal blower 1D of the double suction type is configured so that the distance between the outer circumferential edge 35 of the centrifugal fan 3 and the tongue portion 8 is smaller on the main plate 31 side of the centrifugal fan 3 (i.e., in the center part in the direction of the rotation axis A) than on the side plate 32 side of the centrifugal fan 3 (i.e., in each of the two end parts in the direction of the rotation axis A), and therefore the noise can be reduced and the efficiency can be enhanced.

Sixth Embodiment

Figure 14:
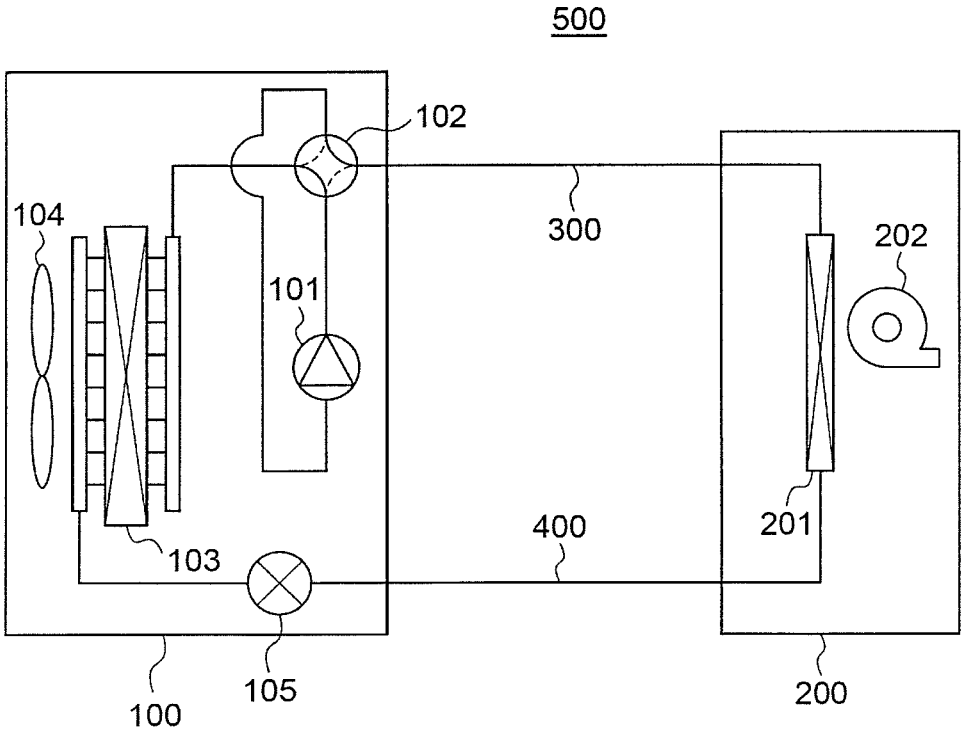
FIG. 14 is a diagram showing a configuration of an air conditioning apparatus according to a sixth embodiment of the present invention.

FIG. 14 is a diagram showing a configuration of an air conditioning apparatus 500 according to a sixth embodiment of the present invention. In this sixth embodiment, description will be given of the air conditioning apparatus 500 including a refrigerating cycle apparatus having an indoor unit 200 to which the centrifugal blowers described in the first to fifth embodiments are applied.

The air conditioning apparatus 500 shown in FIG. 14 includes an outdoor unit 100 and the indoor unit 200. The outdoor unit 100 and the indoor unit 200 are connected to each other by a gas piping 300 and a liquid piping 400 that serve as refrigerant piping. The outdoor unit 100, the indoor unit 200, the gas piping 300 and the liquid piping 400 constitute a refrigerant circuit that allows refrigerant to flow. The gas piping 300 allows refrigerant in a gas state (gas refrigerant) to flow. The liquid piping 400 allows refrigerant in a liquid state (liquid refrigerant) or in a gas-liquid two-phase state to flow.

The outdoor unit 100 in this example includes a compressor 101, a four-way valve (a channel switching valve) 102, an outdoor-side heat exchanger 103, an outdoor-side blower 104, and a restrictor (an expansion valve) 105.

The compressor 101 compresses the refrigerant taken in and delivers the compressed refrigerant. The compressor 101 includes, for example, an inverter device or the like and is configured to be able to finely change a capacity of the compressor 101 (an amount of refrigerant delivered per unit time) by freely changing an operation frequency. The four-way valve 102 switches a flow path of the refrigerant depending on an operation, i.e., a heating operation or a cooling operation, based on a command from a control device (not shown).

The outdoor-side heat exchanger 103 performs heat exchange between the refrigerant and air (outdoor air). For example, in the heating operation, the outdoor-side heat exchanger 103 functions as an evaporator. Specifically, the outdoor-side heat exchanger 103 performs heat exchange between air and the low-pressure refrigerant flowing in from the liquid piping 400 via the restrictor 105, and thereby evaporates (gasifies) the refrigerant. In the cooling operation, the outdoor-side heat exchanger 103 functions as a condenser. Specifically, the outdoor-side heat exchanger 103 performs heat exchange between air and the refrigerant compressed by the compressor 101 and flowing in via the four-way valve 102, and thereby condenses and liquefies the refrigerant.

The outdoor-side blower 104 supplies outdoor air to the outdoor-side heat exchanger 103. The outdoor-side blower 104 may also be configured to finely change a rotation speed of a fan by freely changing an operation frequency of a fan motor using an inverter device. The restrictor 105 regulates a pressure or the like of the refrigerant flowing through the liquid piping 400 by changing an opening degree.

The indoor unit 200 includes a load-side heat exchanger 201 and a load-side blower 202. The load-side heat exchanger 201 performs heat exchange between the refrigerant and air (indoor air). In the heating operation, the load-side heat exchanger 201 functions as a condenser. Specifically, the load-side heat exchanger 201 performs heat exchange between air and the refrigerant flowing in from the gas piping 300, thereby condenses and liquefies the refrigerant (or transforms the refrigerant into the gas-liquid two-phase state), and delivers the refrigerant to the liquid piping 400. In the cooling operation, the load-side heat exchanger 201 functions as an evaporator. Specifically, the load-side heat exchanger 201 performs heat exchange between air and the refrigerant brought into a low pressure state by the restrictor 105, evaporates (gasifies) the refrigerant by allowing the refrigerant to absorb heat from the air, and delivers the refrigerant to the gas piping 300.

The load-side blower 202 supplies indoor air to the load-side heat exchanger 201. An operating speed of the load-side blower 202 is determined by, for example, a setting made by a user.

In the air conditioning apparatus 500 according to the sixth embodiment, the centrifugal blowers 1 to 1D described in the first to fifth embodiments may be employed for the load-side blower 202 of the indoor unit 200. Further, the centrifugal blowers 1 to 1D described in the first to fifth embodiments may also be employed for the outdoor-side blower 104 of the outdoor unit 100.

In the air conditioning apparatus 500 according to the sixth embodiment, the efficiency can be enhanced and the noise can be reduced by employing the centrifugal blowers 1 to 1D described in the first to fifth embodiments for the outdoor-side blower 104, the load-side blower 202, or both of the outdoor-side blower 104 and the load-side blower 202.

While preferred embodiments of the present invention have been specifically described above, the present invention is not restricted to the above described embodiments and a variety of improvements or modifications may be made without departing from the scope of the present invention.

The present invention can be widely employed for various types of devices equipped with a blower, such as, for example, an indoor unit and an outdoor unit of an air conditioning apparatus and a refrigerating cycle apparatus.

What is claimed is:

1. A centrifugal blower comprising:

a centrifugal fan having a main plate and a side plate facing each other in a direction of a rotation axis; and a casing to house the centrifugal fan, wherein the casing has a peripheral wall extending along an outer circumferential edge of the centrifugal fan, and has a tongue portion at a position on the peripheral wall, and wherein width of an air channel between the outer circumferential edge of the centrifugal fan and the tongue portion is narrower on the main plate side of the centrifugal fan than on the side plate side of the centrifugal fan.

2. The centrifugal blower according to claim 1, wherein a distance between the rotation axis of the centrifugal fan and the peripheral wall of the casing increases in a rotating direction of the centrifugal fan from the tongue portion as a starting point.

3. The centrifugal blower according to claim 1, wherein the tongue portion has a first part on the main plate side of the centrifugal fan and a second part on the side plate side of the centrifugal fan, wherein a distance between the outer circumferential edge of the centrifugal fan and the first part is smaller than a distance between the outer circumferential edge of the centrifugal fan and the second part, and wherein the first part has a certain length in the direction of the rotation axis of the centrifugal fan.

4. The centrifugal blower according to claim 1, wherein a relationship $D1/D3 \geq 0.03$ is satisfied, when a distance between the outer circumferential edge of the centrifugal fan and the tongue portion is represented by D1 on the main plate side of the centrifugal fan, and a diameter of the centrifugal fan is represented by D3.

5. The centrifugal blower according to claim 1, wherein an upstream end of the tongue portion in a rotating direction of the centrifugal fan has a curved surface portion protruding toward the centrifugal fan.

6. The centrifugal blower according to claim 1, wherein the tongue portion is provided with a boundary portion between the main plate side of the centrifugal fan and the side plate side of the centrifugal fan, and a distance from the outer circumferential edge of the centrifugal fan to the boundary portion continuously changes.

7. The centrifugal blower according to claim 6, wherein the boundary portion has an inclination angle larger than or equal to 60 degrees with respect to a plane perpendicular to the rotation axis of the centrifugal fan.

8. The centrifugal blower according to claim 1, wherein the tongue portion has a distance-reducing portion disposed outside the side plate in the direction of the rotation axis of the centrifugal fan, and wherein a distance between the outer circumferential edge of the centrifugal fan and the distance-reducing portion is smaller than the distance between the outer circumferential edge of the centrifugal fan and the tongue portion on the side plate side of the centrifugal fan.

9. The centrifugal blower according to claim 8, wherein a relationship $E \leq D2-D1$ is satisfied, when a distance between the outer circumferential edge of the centrifugal fan and the tongue portion is represented by D1 on the main plate side of the centrifugal fan and is represented by D2 on the side plate side of the centrifugal fan, and when a distance between the distance-reducing portion and the tongue portion on the side plate side of the centrifugal fan in a radial direction of the centrifugal fan is represented by E.

10. The centrifugal blower according to claim 1, wherein the casing has a diffuser portion whose width increases in a direction of an air flow blown out from the centrifugal fan, and wherein the diffuser portion has an enlarging portion on the main plate side of the centrifugal fan to make the width wider on the main plate side of the centrifugal fan than on the side plate side of the centrifugal fan.

11. The centrifugal blower according to claim 10, wherein a relationship W1/W2<1.1 is satisfied, when the width of the diffuser portion is represented by W1 on the main plate side of the centrifugal fan and is represented by W2 on the side plate side of the centrifugal fan.

12. An air conditioning apparatus comprising:

the centrifugal blower according to claim 1, and a heat exchanger to which air is supplied by the centrifugal blower.

13. A refrigerating cycle apparatus comprising:

the centrifugal blower according to claim 1, and a heat exchanger to which air is supplied by the centrifugal blower.

14. The centrifugal blower according to claim 1, wherein the centrifugal fan has the main plate in a center part in the direction of the rotation axis, and the side plate in each of two end parts in the direction of the rotation axis, wherein the casing has intake ports on both sides of the centrifugal fan in the direction of the rotation axis.

15. A centrifugal blower comprising:

a centrifugal fan having a main plate and a side plate facing each other in a direction of a rotation axis; and a casing to house the centrifugal fan, wherein the casing has a peripheral wall extending along an outer circumferential edge of the centrifugal fan, and has a tongue portion at a position on the peripheral wall, wherein a distance between the outer circumferential edge of the centrifugal fan and the tongue portion is smaller on the main plate side of the centrifugal fan than on the side plate side of the centrifugal fan, wherein a distance between the rotation axis of the centrifugal fan and the peripheral wall of the casing increases in a rotating direction of the centrifugal fan from the tongue portion as a starting point, and wherein an increasing rate of the distance between the rotation axis of the centrifugal fan and the peripheral wall of the casing is higher on the main plate side of the centrifugal fan than on the side plate side of the centrifugal fan.

16. A centrifugal blower comprising:

a centrifugal fan having a main plate and a side plate facing each other in a direction of a rotation axis; and a casing to house the centrifugal fan, wherein the casing has a peripheral wall extending along an outer circumferential edge of the centrifugal fan, and has a tongue portion at a position on the peripheral wall, wherein a distance between the outer circumferential edge of the centrifugal fan and the tongue portion is smaller on the main plate side of the centrifugal fan than on the side plate side of the centrifugal fan, and wherein, in a range of a certain angle from the tongue portion as a starting point about the rotation axis of the centrifugal fan, a distance between the outer circumferential edge of the centrifugal fan and the peripheral wall of the casing is smaller on the main plate side of the centrifugal fan than on the side plate side of the centrifugal fan.

17. The centrifugal blower according to claim 16, wherein the angle is smaller than or equal to 90 degrees.

18. A centrifugal blower comprising:

a centrifugal fan having a main plate and a side plate facing each other in a direction of a rotation axis; and a casing to house the centrifugal fan, wherein the casing has a peripheral wall extending along an outer circumferential edge of the centrifugal fan, and has a tongue portion at a position on the peripheral wall, wherein a distance between the outer circumferential edge of the centrifugal fan and the tongue portion is smaller on the main plate side of the centrifugal fan than on the side plate side of the centrifugal fan, and wherein a relationship D1/D2≥⅓ is satisfied, when the distance between the outer circumferential edge of the centrifugal fan and the tongue portion is represented by D1 on the main plate side of the centrifugal fan and is represented by D2 on the side plate side of the centrifugal fan.

19. A centrifugal blower comprising:

a centrifugal fan having a main plate and a side plate facing each other in a direction of a rotation axis; and a casing to house the centrifugal fan, wherein the casing has a peripheral wall extending along an outer circumferential edge of the centrifugal fan, and has a tongue portion at a position on the peripheral wall, wherein a distance between the outer circumferential edge of the centrifugal fan and the tongue portion is smaller on the main plate side of the centrifugal fan than on the side plate side of the centrifugal fan, wherein an upstream end of the tongue portion in a rotating direction of the centrifugal fan has a curved surface portion protruding toward the centrifugal fan, and wherein a curvature radius of the curved surface portion of the tongue portion is larger on the main plate side of the centrifugal fan than on the side plate side of the centrifugal fan.

20. The centrifugal blower according to claim 19, wherein a relationship R1/R2≤3 is satisfied, when the curvature radius of the curved surface portion of the tongue portion is represented by R1 on the main plate side of the centrifugal fan and is represented by R2 on the side plate side of the centrifugal fan.

* * * * *